United States Patent [19]

Gautier

[11] Patent Number: 4,804,418

[45] Date of Patent: Feb. 14, 1989

[54] PROCESS AND OUTFIT FOR THE EXTRACTION OF SUGAR FROM SUGAR CANE

[75] Inventor: Alain Gautier, Arras, France

[73] Assignee: Maguin S. A., B. P., La Fere, France

[21] Appl. No.: 909,747

[22] Filed: Sep. 19, 1986

[30] Foreign Application Priority Data

Sep. 19, 1985 [FR] France ..... 85 13843

[51] Int. Cl.[4] ..... C13C 3/00

[52] U.S. Cl. ..... 127/2; 127/4; 127/9; 127/43; 100/73; 100/74; 100/75; 100/155 R; 422/269; 422/273; 426/489

[58] Field of Search ..... 127/2, 9, 4, 43; 100/73, 74, 75, 155 R, 176; 422/269, 273; 426/489

[56] References Cited

U.S. PATENT DOCUMENTS

| | | | |
|---|---|---|---|
| 1,398,252 | 11/1921 | Bartlemay | 100/176 |
| 1,451,164 | 4/1923 | Hurter | 100/176 |
| 1,482,005 | 1/1924 | Giordano | 100/176 |
| 1,688,905 | 10/1928 | Vazquez | 127/4 |
| 3,695,931 | 10/1974 | Hamill | 100/75 |
| 3,976,498 | 8/1976 | Tilby et al. | 127/2 |
| 4,043,832 | 8/1977 | Leibig et al. | 127/4 |

OTHER PUBLICATIONS

International Sugar Journal, vol. 78, No. 936 (1976–6).

*Primary Examiner*—H. M. S. Sneed
*Assistant Examiner*—Chung K. Pak
*Attorney, Agent, or Firm*—Armstrong, Nikaido, Marmelstein & Kubovcik

[57] ABSTRACT

Processing and outfit for the extraction of cane sugar by pressing canes and magma between several pairs of fluted rollers, wherein each pair of rollers is completely submerged in a tank (C) and fed through a hopper (13), and wherein a constant recirculation of the magma, from each tank towards the corresponding hopper, with a significant flow rate on the one hand, and a counter-current circulation of the bagasse and the juice with a lower flow rate in the different tanks ($C_1$, $C_2$, $C_3$) corresponding to the different pairs of rollers on the other, are combined.

8 Claims, 4 Drawing Sheets

PROCESS AND OUTFIT FOR THE EXTRACTION OF SUGAR FROM SUGAR CANE

FIELD OF THE INVENTION

The invention relates to the extraction of sugar from sugar cane.

BACKGROUND OF THE INVENTION

The conventional extraction process, the oldest known, consists in grinding the canes with an impact disk mill in order to open the cells, and then passing the preparation obtained through cane mills consisting of fluted rollers which exert a high pressure of 50 to 100 bars between them. The outfit is relatively expensive and consumes a large amount of energy for driving these rollers. Additionally, for producing high yields, the outfit needs to be of a considerable size.

The use of the diffusion process for the extraction of beet sugar has cost the manufacturers to seek the adaptation thereof for cane sugar. In such a diffusion process, ground canes are suspended in water in order to carry out the extraction by diffusion, maceration and leaching. The diffusion is carried out in large equipment according to the conventional countercurrent exhaustion process, which leads to significant extraction times and especially to large tank volumes, therefore to expensive and bulky outfits, with additionally difficulties of operation, especially due to fermentation problems.

The conventional process was later re-adopted to improve it and to lead to the re-soaking process. This process essentially consists in irrigating the prepared cane with extracted juice and crushing it again in a mill following the first, the process being carried out by means of several successive re-soakings and several mills, in order to improve the extraction yield. The result is that the efficiency of the whole equipment is improved. Despite this improvement, the complete outfit remains expensive, bulky and high energy consuming, as against the increase in the extraction yield.

This last process has been the subject of many improvements, some of which have brought to light the harmful role played by the absorption of air by cells which expand elastically immediately after crushing. In fact, this air prevents an effective soaking by the liquid and unnecessarily consumes energy by its compressibility. In order to avoid this, some of the processes proposed provide for the de-aeration of the mixtures, or for the irrigation of the bagasse immediately after it leaves the mill, but without ever achieving the complete elimination of this presence of air.

SUMMARY OF THE INVENTION

The object of the invention is to provide an extraction process with good yield and low cost which eliminates the disadvantages above, which, in particular, reduces the size of outfits and which employs a lower power than that of conventional processes, even if they were improved, this being achieved mainly by multiple passages at low pressure in an aqueous medium which therefore systematically avoids air being taken up.

The invention consists in pressing previously prepared canes, and then the magma (preparation and juice) between several pairs of fluted rollers, each pair being completely submerged in a tank and fed with a hopper, and this is done by combining a constant circulation of the magma from each tank towards the corresponding hopper at a high flow rate on the one hand, and a countercurrent circulation of the preparation and the juice at a lower flow rate in the various tanks corresponding to the different pairs of rollers on the other.

For the implementation of this process, the outfit therefore comprises a series of tanks, in a lower number, each containing a pair of fluted rollers fitted with a feed hopper above, with means to ensure the recycling and other means to ensure the countercurrent circulation of the preparation and of the juice.

In particular, the circulation of the juice is advantageously carried out by simple overflow from one tank to the other, the tanks being placed at staggered heights, with magma recirculation pumps raising the magma from a tank towards the corresponding hopper, and magma transfer pumps raising the magma from a tank towards the hopper of the tank situated upstream (or towards the bagasse outlet of the most upstream tank).

In order to ensure the regularity of these circulations, the transfer pumps each pour the magma over a curved grid separator, the drained juice being brought back towards the tank that the magma comes from, whereas the drained preparation flows by gravity into the corresponding hopper or towards the outlet. Additionally, the chutes for the transfer of the juice by overflow from an upstream tank towards a downstream tank are preferably also equipped with a curved grid constantly swept by the blades of a rotary paddle in order to allow the juice to pass through, but to return the preparation constantly into the upstream tank.

BRIEF DESCRIPTION OF THE DRAWINGS

Other characteristics of the invention will become apparent in the description which follows of an embodiment taken by way of example and represented in the attached drawing, on which.

DESCRIPTION OF THE PREFERRED EMBODIMENTS

Figure 1:
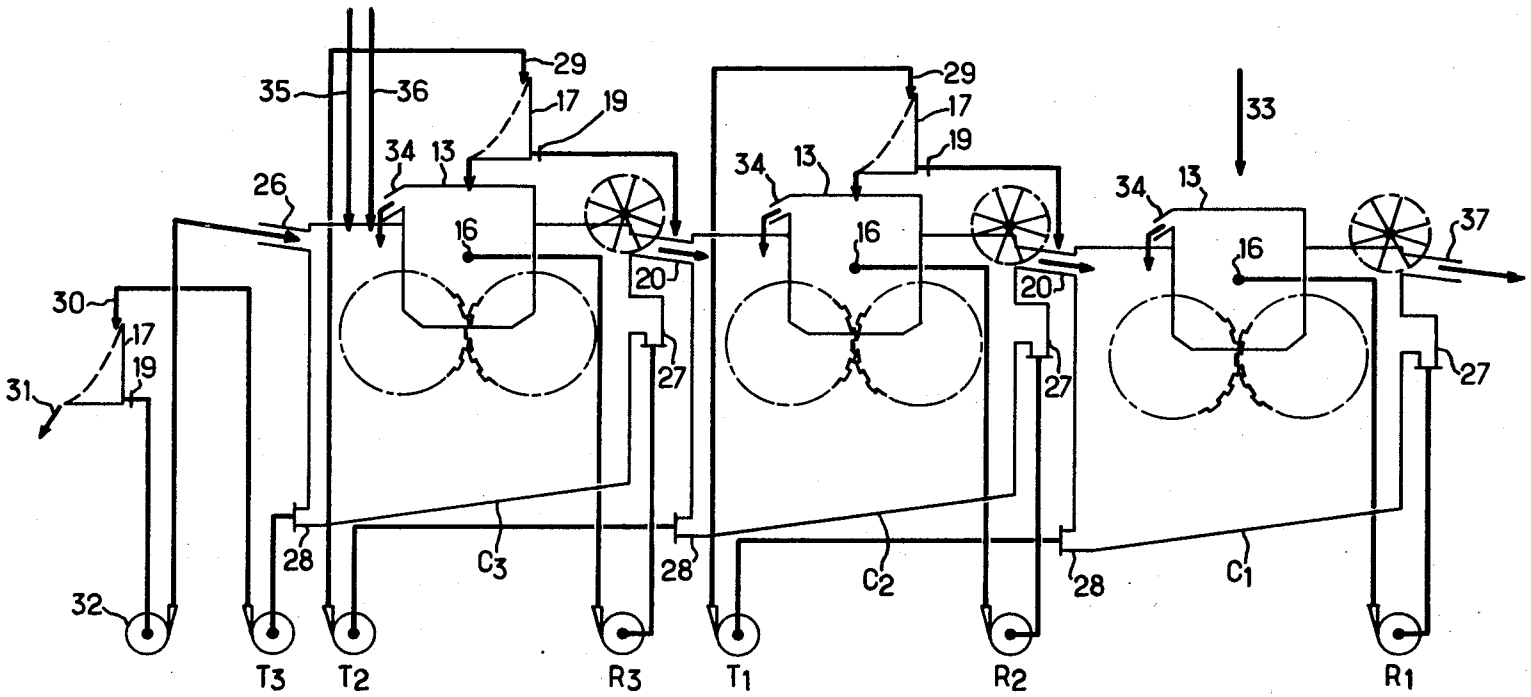
FIG. 1 represents the general outline of the process.
Figure 2:
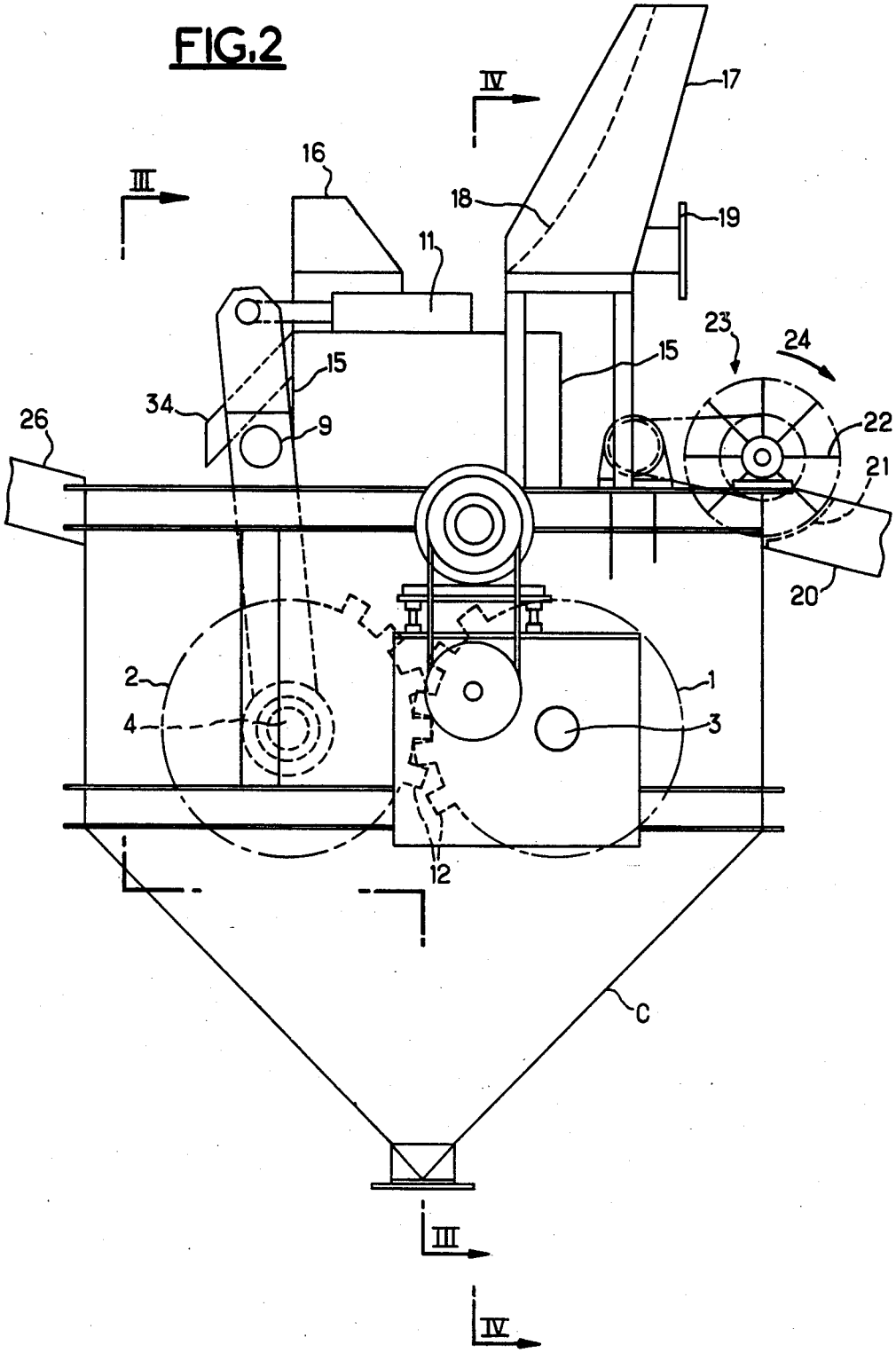
FIG. 2 represents, in greater detail, an extraction cell.
Figure 3:
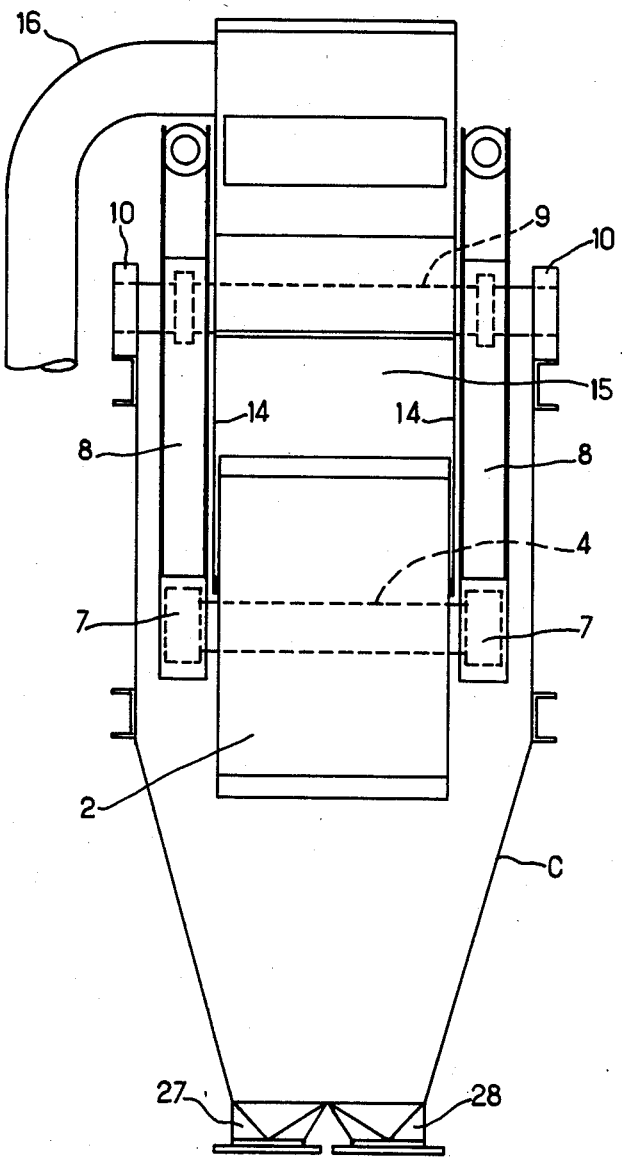
FIG. 3 is a vertical cross-section along III—III of FIG. 2.
Figure 4:
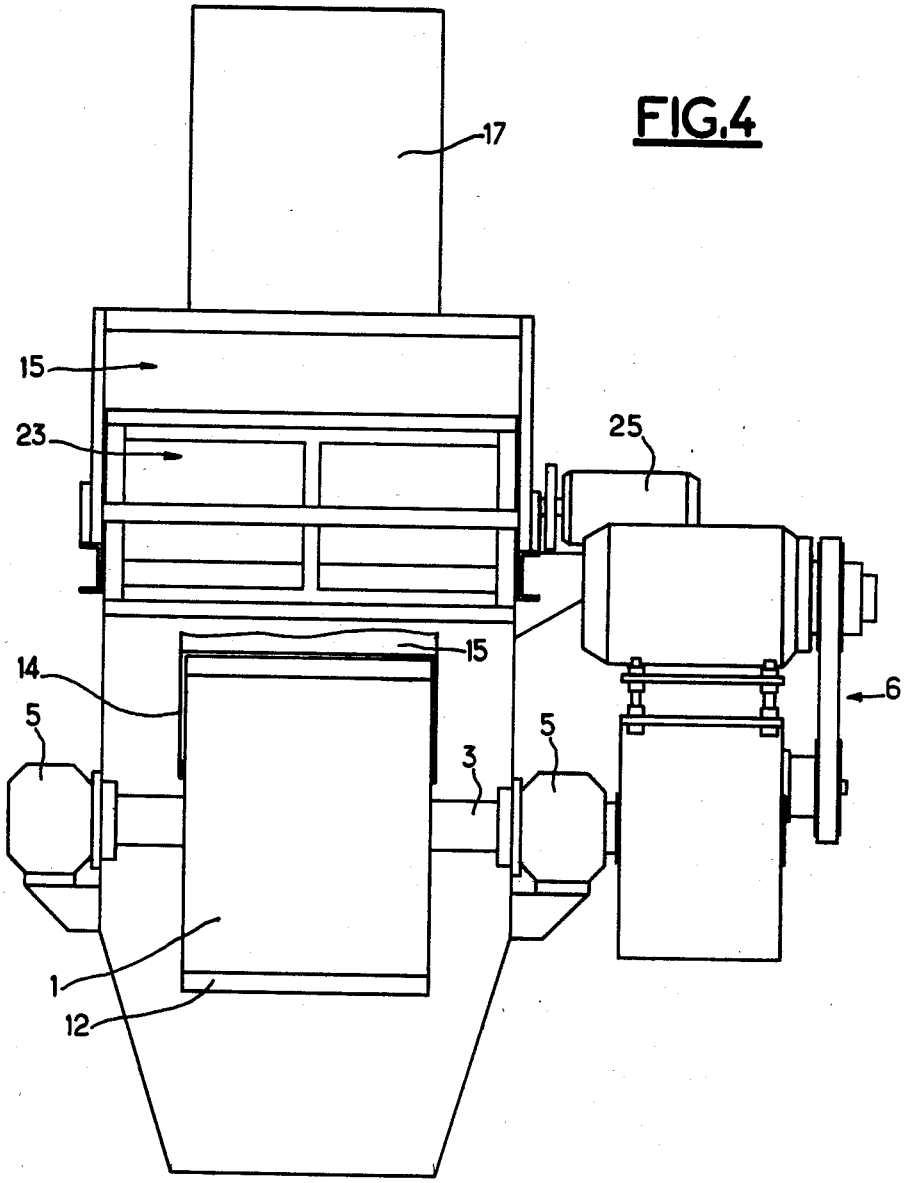
FIG. 4 is also a vertical cross-section along IV—IV of FIG. 2.

Each extraction cell comprises, according to the invention, a pair of fluted rollers 1 and 2 with horizontal axes 3 and 4 completely immersed in a tank C. The cylinder 1 is motive, and its axis 3, without clearance, passes through the sides of the tank with caulkers 5, one of the ends of the shaft 3 being driven by an optionally variable-speed geared motor mechanism 6. The other roller 2 has its axis 4 which revolves in bearings 7 situated at the end of the substantially vertical arms 8 of a partially submerged stirrup, which ensures the horizontal clearance of the shaft 4 without having to pass through the side. In addition to the vertical arms 8, this stirrup consists of a shaft 9 assembled in bearings 10 attached to the tank. The pressing of the roller 2 against the roller 1 is ensured by one or two lateral thrustors 11 located outside the tank C. The roller 2 with clearance is assembled idle, and driven directly by the motor roller 1 by means of large flutings 12 which engage into each other.

A feeding hopper 13 which consists of two end plates 14, connected in an almost sealed manner with the end faces of the rollers, and two vertical lateral sides 15 connecting with the periphery of these rollers is assembled above this pair of rollers 1 and 2. The leak-proofness of these various connections of the hopper 13 with the pair of rollers need not be perfect, given that it only separates media which, in any case, are put into permanent circulation with a high flow rate.

Each hopper 13 comprises a double feeding: a tube 16 pours magma therein on the one hand and a separator 17, with curved grid 18, pours crudely drained preparation therein, the juice drained leaving at 19 to be returned to the downstream tank.

Each tank C comprises an overflow exit chute 20, which is also closed with a curved grid 21, the surface of which is constantly swept by the blades 22 of a paddle 23 driven in rotation in the direction of the arrow 24 by a geared motor 25, so as to return the preparation which accumulates against the grid 21 constantly towards the tank. The tank C also comprises an entry chute 26 for the most upstream tank $C_3$, this entry chute 26 consisting of the exit chute 20 of the previous tank for the other tanks $C_2$, $C_1$. Finally, the tank C comprises two tube exits 27 and 28 for the magma.

A certain number of similar cells, three in the example chosen, are assembled in series, so that each exit chute 20 is the entry 26 of the following tank, as represented in more detail in FIG. 1. Additionally, the outfit is complete with a series of pumps intended to ensure systematic circulation.

There are, in particular, three recirculation pumps $R_1$, $R_2$ and $R_3$, associated with the tanks $C_1$, $C_2$ and $C_3$ respectively, and which are magma pumps sucking the magma at the outlet 27 of each tank and driving it back into the feed 16 of the corresponding hopper 13. Besides, there are three transfer pumps $T_1$, $T_2$ and $T_3$ which are also magma pumps connected to the exit 28 of the corresponding tank and which pour the magma at 29, above the separator 17 with curved grid 18 of the tank upstream for $T_1$, and $T_2$, or at 30 above a final separator 17 with curved grid 18 feeding the bagasse exit 31. The juice outlets 19 of the different separators 17 pour the juice into the downstream tank, that is, the tank that the magma pumped comes from, this being by simple natural flow, or by means of a pump 32 if required.

The prepared canes are fed at 33 into the hopper of the downstream tank. They are pressed by the first pair of rollers and recycled several times by positive drive due to the systematic recirculation. Naturally, the speed of the rollers is adjusted according to both the rate at which the canes arrive at 33 and the rate of recirculation arriving at 16, and the recirculation pump of each tank is adjusted in order to ensure this flow rate with a slight excess which flows through the weir 34 contained in each hopper 13. According to the invention, the various parameters are determined so that the recycling flow rate is much higher than the flow rate for the main product, for example five times this flow rate. Therefore in principle each cell performs five pressings-re-soakings, which increases the efficiency of the outfit significantly and, in particular, makes it possible to obtain high extraction yields with a smaller number of extraction cells, for example three in the example represented.

Besides this systematic recirculation, an extraction by systematic exhaustion also takes place due to the countercurrent circulation of the preparation and the juice.

In fact, if the path of the preparation is followed, from the entry of the canes at 33, the latter after several circulations in the tank $C_1$ is directed by the transfer pump $T_1$ and by the corresponding separator 17 towards the tank $C_2$, where it again undergoes five pressings-re-soakings in a less concentrated juice, then it is directed in the same way by the transfer pump $T_2$ into the tank $C_3$ where it undergoes a further five pressings-re-soakings in an even less concentrated juice, before being taken up by the transfer pump $T_3$ and directed towards the bagasse exit 31, where it is taken up in conventional presses to separate the completely exhausted bagasse from the slightly concentrated juice which is directed at 35 into the upstream tank $C_3$. This tank $C_3$ also receives the juice recovered at 19 of the last separator 17 and which is directed at 26, at the same time as a pure water supply 36 to make up for losses. It has been observed in particular that the grids 21 and the paddle 23 prevent the bagasse from being driven in the opposite direction.

Conversely, the juice circulates in the opposite direction starting from weakly concentrated products originating from the mixture of the juice recovered at 26, pressing water returned at 35 and pure water added at 36, this mixture being enriched in sugar in the tank $C_3$ and circulating from upstream to downstream with a gradually increasing concentration, to leave at 37 at its maximum concentration from which it is then purified and separated by conventional means.

It is because of this systematic circulation combined with the recirculation at a high level that the invention makes it possible to obtain high extraction yields with a small number of cells, therefore with an inexpensive and not very bulky outfit. Furthermore, given that the rollers operate in a completely submerged medium, the disadvantages due to the introduction of air into the cells are completely eliminated and it is possible to work with relatively moderate roller pressures and also moderate energy consumption for driving the rollers. Finally, the complete outfit is simple to manufacture and easy to operate.

I claim:

1. An apparatus for extraction of cane sugar juice by water from prepared sugar canes by treating magma to produce concentrated juice and bagasse, said apparatus comprising:

plural extraction cells;

each extraction cell including:

a tank, a pair of fluted rollers completely immersed in magma in said tank, rotation means for rotating said pair of rollers, a feeding hopper positioned directly above and partially surrounding said pair of rollers including a nip portion thereof;

connecting means for connecting said cells in series, from a first cell to a last cell, with respect to flow of juice;

said connecting means comprises downwardly sloping overflow chutes extending from an upstream tank to an adjacent downstream tank such that the circulation of the juice is carried out by overflow from the upstream to the downstream tank;

water supply means for supplying water to said first cell;

countercurrent flow means for connecting said cells, from said last cell to said first cell, for countercurrent flow of bagasse;

sugar cane supply means for supplying prepared sugar canes to said last cell;

a recirculation pump means for circulating magma from the tank to the feeding hopper above said tank so that said sugar cane passes through the same pair of rollers in each of said extraction cells several times while being immersed;

bagasse removal means for removing bagasse from said first cell; and juice removal means for removing concentrated juice from said last cell.

2. The apparatus as claimed in claim 1, wherein said connecting means further comprises connecting a curved grid extending transversely across each chute adjacent said upstream tank, and sweeping means associated with each curved grid for sweeping bagasse back into said upstream tank while permitting flow of juice to said adjacent downstream tank.

3. The apparatus as claimed in claim 1, wherein said juice removal means for removing concentrated juice from said last cell comprises a downwardly sloping overflow chute, a curved grid extending transversely across said overflow chute, and sweeping means associated with said curved grid for sweeping bagasse back into the tank of said last cell while permitting flow of concentrated juice.

4. The apparatus as claimed in claim 1, wherein said countercurrent flow means for connecting said cells from said last cell to said first cell for countercurrent flow of bagasse comprises transfer pump means for transferring magma from a downstream tank with respect to flow of juice to an adjacent upstream tank, and separator means positioned above feeding hopper of said adjacent upstream tank for separating bagasse from the magma and for feeding the separated bagasse to said upstream tank and the juice to said downstream tank.

5. The apparatus as claimed in claim 1, wherein said bagasse removal means for removing bagasse from said first cell comprises transfer pump means for transferring magma from the tank of said first cell, and separator means for separating bagasse from the magma and for feeding the juice therefrom back to said tank of said first cell.

6. The apparatus as claimed in claim 1, wherein each cell further comprises a rotatable drive shaft extending laterally through said tank upon which one of said pair of fluted rollers is mounted, a pair of parallel vertical arms pivotally mounted to said tank, each arm having one end extending into said tank, the other of said pair of fluted rollers being rotatably mounted on said one ends of said pair of arms in parallel with said drive shaft and with flutings thereof engaged with flutings of said one of said pair of fluted rollers, and at least one thruster mounted on said tank bearing against at least one of said pair of arms to pivot said pair of arms to urge said other of said pair of rollers into engagement with said one of said pair of rollers; and wherein said means for rotating said pair of rollers comprises motor rotation means connected to and rotating said drive shaft.

7. The apparatus as claimed in claim 2, wherein each cell further comprises a rotatable drive shaft extending laterally through said tank upon which one of said pair of fluted rollers is mounted, a pair of parallel vertical arms pivotally mounted to said tank, each arm having one end extending into said tank, the other of said pair of fluted rollers being rotatably mounted on said one ends of said pair of arms in parallel with said drive shaft and with flutings thereof engaged with flutings of said one of said pair of fluted rollers, and at least one thruster mounted on said tank bearing against at least one of said pair of arms to pivot said pair of arms to urge said other of said pair of rollers into engagement with said one of said pair of rollers; and wherein said rotation means for rotating said pair of rollers comprises motor means connected to and rotating said drive shaft.

8. The apparatus as claimed in claim 5, wherein each cell further comprises a rotatable drive shaft extending laterally through said tank upon which one of said pair of fluted rollers is mounted, a pair of parallel vertical arms pivotally mounted to said tank, each arm having one end extending into said tank, the other of said pair of fluted rollers being rotatably mounted on said one ends of said pair of arms in parallel with said drive shaft and with flutings thereof engaged with flutings of said one of said pair of fluted rollers, and at least one thruster mounted on said tank bearing against at least one of said pair of arms to pivot said pair of arms to urge said other of said pair of rollers into engagement with said one of said pair of rollers; and wherein said rotation means for rotating said pair of rollers comprises motor means connected to and rotating said drive shaft.

* * * * *